US008997988B2

(12) United States Patent
Shi

(10) Patent No.: US 8,997,988 B2
(45) Date of Patent: Apr. 7, 2015

(54) LIQUID CRYSTAL MODULE PACKAGE BOX

(71) Applicant: Shenzhen China Star Optoelectronics Technology Co., Ltd., Shenzhen, Guangdong (CN)

(72) Inventor: Qinjun Shi, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 266 days.

(21) Appl. No.: 13/805,644

(22) PCT Filed: Oct. 24, 2012

(86) PCT No.: PCT/CN2012/083394

§ 371 (c)(1),
(2) Date: Dec. 19, 2012

(87) PCT Pub. No.: WO2014/056255

PCT Pub. Date: Apr. 17, 2014

(65) Prior Publication Data

US 2014/0102937 A1 Apr. 17, 2014

(51) Int. Cl.

| | |
|---|---|
| ***B65D 81/127*** | (2006.01) |
| ***B65D 81/113*** | (2006.01) |
| ***B65D 5/49*** | (2006.01) |
| ***B65D 5/498*** | (2006.01) |

(52) U.S. Cl.

CPC ..... *B65D 81/127* (2013.01); *B65D 81/113* (2013.01); *B65D 5/48046* (2013.01); *B65D 5/48048* (2013.01)

(58) Field of Classification Search

CPC ..... B65D 85/30; B65D 85/45; B65D 81/127; B65D 81/05; B65D 81/107; B65D 81/053; B65D 81/058; B65D 81/113; B65D 5/48048

USPC ..... 206/454, 453, 587, 586, 523, 451, 521

See application file for complete search history.

(56) References Cited

U.S. PATENT DOCUMENTS

| | | | | |
|---|---|---|---|---|
| 6,837,421 | B1 * | 1/2005 | Li et al. | 229/120.32 |
| 7,374,044 | B2 * | 5/2008 | Ting | 206/454 |
| 7,604,120 | B2 * | 10/2009 | Ting et al. | 206/454 |
| 7,604,121 | B1 * | 10/2009 | Tang et al. | 206/454 |

(Continued)

FOREIGN PATENT DOCUMENTS

| | | | |
|---|---|---|---|
| CN | 102700851 | A | 10/2012 |
| TW | 456363 | U | 9/2001 |

*Primary Examiner* — Steven A. Reynolds
(74) *Attorney, Agent, or Firm* — Andrew C. Cheng

(57) ABSTRACT

A liquid crystal module package box includes a box body, top and bottom lids coupled to top and bottom of the box body, a cushioning retention frame received in the box body, cushioning pads arranged at two sides of the cushioning retention frame, and a support unit arranged at a central portion of the box body. The cushioning retention frame includes two lower cushioning brackets and four upper cushioning brackets corresponding to the two lower cushioning brackets. The support unit includes two support boards. When liquid crystal modules are positioned on the lower cushioning brackets, every two of the upper cushioning brackets are set on the liquid crystal modules to correspond to each one of the lower cushioning brackets. The two support boards are retained between the two lower cushioning brackets to increase central compression strength of the liquid crystal module package box at the central portion.

6 Claims, 3 Drawing Sheets

(56) References Cited

U.S. PATENT DOCUMENTS

| | | | | |
|---|---|---|---|---|
| 8,227,057 | B2 * | 7/2012 | Wang | 428/34.2 |
| 8,251,220 | B2 * | 8/2012 | Ting et al. | 206/587 |
| 8,720,691 | B2 * | 5/2014 | Hu | 206/587 |
| 8,777,008 | B2 * | 7/2014 | Hu | 206/454 |
| 8,827,076 | B2 * | 9/2014 | Kuo | 206/454 |
| 2005/0087470 | A1 * | 4/2005 | Chuang et al. | 206/503 |
| 2010/0075097 | A1 * | 3/2010 | Wang | 428/59 |
| 2011/0056868 | A1 * | 3/2011 | Ting et al. | 206/587 |
| 2012/0211398 | A1 * | 8/2012 | Hu | 206/725 |
| 2013/0233759 | A1 * | 9/2013 | Chan et al. | 206/589 |
| 2013/0270332 | A1 * | 10/2013 | Kuo | 229/120.02 |
| 2014/0001085 | A1 * | 1/2014 | Zhao | 206/722 |
| 2014/0183083 | A1 * | 7/2014 | Zhao | 206/523 |

* cited by examiner

LIQUID CRYSTAL MODULE PACKAGE BOX

BACKGROUND OF THE INVENTION

1. Field of the Invention

The present invention relates to the field of liquid crystal display, and in particular to a liquid crystal module package box.

2. The Related Arts

Liquid crystal display (LCD) has a variety of advantages, such as thin device body, low power consumption, and being free of radiation, and is thus widely used. Most of the LCDs that are currently available in the market are backlighting LCDs, which comprise a liquid crystal panel and a backlight module. The operation principle of the liquid crystal panel is that liquid crystal molecules are interposed between two parallel glass substrates and electricity is applied to the glass substrates to control variation of orientation of the liquid crystal molecules in order to refract light emitting from the backlight module for generating images.

In the field of manufacture of liquid crystal devices, the manufacture of liquid crystal devices includes a process of assembling, which assembles various components, including a liquid crystal module, a main control circuit, and an enclosure, together. These components are each manufactured in batch production in advance and stored for being later assembled to form a complete liquid crystal device. The liquid crystal modules, after production, are stored in liquid crystal module package boxes for transportation and shipping.

It is inevitable that a liquid crystal module may be impacted by external forces and accidentally falling during the transportation and shipping thereof. To well protect the liquid crystal module, it is desired to use a liquid crystal module packaging device to effect positioning and cushioning of the liquid crystal module.

To increase the box loading capacity of the currently available mass-produced liquid crystal module package box, packaging is often done in a form of multi-panel box. In addition, the existing way of packaging is alternating packaging by insertion corrugated boards at opposite sides, where no structure is provided in the middle of the package box to support pressure. Or, alternatively, one or two rectangular corrugated boards are used as insertion boards to provide an effect of support. However, the rectangular corrugated boards may get bent and deformed when compressed or humidified, making it not possible to achieve the effect of improving compression strength. In addition, excessive bending may lead to compression of an adjacent module and thus affecting the quality of the liquid crystal module.

SUMMARY OF THE INVENTION

An object of the present invention is to provide a liquid crystal module package box, which improves compression strength at the center of the package box and also reduces the overall weight of the liquid crystal module package box, wherein the liquid crystal module package box is easy to manufacture so as to increase the throughput and reduces packaging cost.

To achieve the object, the present invention provides a liquid crystal module package box, which comprises a box body, top and bottom lids coupled to top and bottom of the box body, a cushioning retention frame received in the box body, cushioning pads arranged at two sides of the cushioning retention frame, and a support unit arranged at a central portion of the box body. The cushioning retention frame comprises two lower cushioning brackets and four upper cushioning brackets corresponding to the two lower cushioning brackets. The support unit comprises two support boards. When liquid crystal modules are positioned on the lower cushioning brackets, every two of the upper cushioning brackets are set on the liquid crystal modules to correspond to each one of the lower cushioning brackets and the two support boards are retained between the two lower cushioning brackets to increase central compression strength of the liquid crystal module package box at the central portion.

The lower cushioning brackets each comprise a first cushioning bottom board and two first cushioning side boards mounted on the first cushioning bottom board and located at two ends of the first cushioning bottom board and three first positioning cushioning boards mounted on the first cushioning bottom board between the two first cushioning side boards in a spaced manner, the two first cushioning side boards both forming a plurality of spaced first mounting slots, the three first positioning cushioning boards forming a plurality of first positioning slots corresponding to the first mounting slots.

The upper cushioning brackets each comprise a second cushioning bottom board, a second cushioning side board mounted at one end of the second cushioning bottom board, and two second positioning cushioning boards respectively mounted at a middle and an opposite end of the second cushioning bottom board, the second cushioning side board forming a plurality of second mounting slots corresponding to the first mounting slots, the second positioning cushioning boards forming a plurality of second positioning slots corresponding to the second mounting slots, the second cushioning side board and the second positioning cushioning boards being mounted to the same surface of the second cushioning bottom board.

The support boards are each in the form of a U-shape and comprise a first main body and two shoulder sections respectively connected to two ends of the first main body, the two support boards being arranged back to back to respectively surround the lower cushioning brackets.

The support boards are each in a linear form and comprise a second main body and a plurality of square tubes mounted to one surface of the second main body, the plurality of square tubes being uniformly arranged on the second main body, each of two ends of the second main body being provided one of the square tubes, the second main body being made of corrugated boards.

Each of the two first cushioning side boards of each of the lower cushioning brackets has two ends that form recesses corresponding to the square tubes of the two ends of each of the second main bodies.

The square tubes are each of a paper roll structure that is directly formed on the second main body with corrugated boards.

The square tubes are paper tubes made by adhesively bonding multiple layers of spool paper or brown paper and are adhesively mounted to the second main body.

The first main body and the two shoulder sections are both made of corrugated boards.

The cushioning pads and the cushioning retention frame are made of foamed materials and the cushioning pads and the cushioning retention frame are made of expandable polyethylene.

The present invention also provides a liquid crystal module package box, which comprises a box body, top and bottom lids coupled to top and bottom of the box body, a cushioning retention frame received in the box body, cushioning pads arranged at two sides of the cushioning retention frame, and a support unit arranged at a central portion of the box body, the cushioning retention frame comprising two lower cushioning brackets and four upper cushioning brackets corresponding to the two lower cushioning brackets, the support unit comprising two support boards, whereby when liquid crystal modules are positioned on the lower cushioning brackets, every two of the upper cushioning brackets are set on the liquid crystal modules to correspond to each one of the lower cushioning brackets and the two support boards are retained between the two lower cushioning brackets to increase central compression strength of the liquid crystal module package box at the central portion; and wherein the lower cushioning brackets each comprise a first cushioning bottom board and two first cushioning side boards mounted on the first cushioning bottom board and located at two ends of the first cushioning bottom board and three first positioning cushioning boards mounted on the first cushioning bottom board between the two first cushioning side boards in a spaced manner, the two first cushioning side boards both forming a plurality of spaced first mounting slots, the three first positioning cushioning boards forming a plurality of first positioning slots corresponding to the first mounting slots;

wherein the upper cushioning brackets each comprise a second cushioning bottom board, a second cushioning side board mounted at one end of the second cushioning bottom board, and two second positioning cushioning boards respectively mounted at a middle and an opposite end of the second cushioning bottom board, the second cushioning side board forming a plurality of second mounting slots corresponding to the first mounting slots, the second positioning cushioning boards forming a plurality of second positioning slots corresponding to the second mounting slots, the second cushioning side board and the second positioning cushioning boards being mounted to the same surface of the second cushioning bottom board;

wherein the support boards are each in the form of a U-shape and comprise a first main body and two shoulder sections respectively connected to two ends of the first main body, the two support boards being arranged back to back to respectively surround the lower cushioning brackets;

wherein the first main body and the two shoulder sections are both made of corrugated boards; and wherein the cushioning pads and the cushioning retention frame are made of foamed materials and the cushioning pads and the cushioning retention frame are made of expandable polyethylene.

The efficacy of the present invention is that the present invention provides a liquid crystal module package box, which comprises a corrugated board made support unit set up in a central portion thereof to improve the compression strength of the liquid crystal module package box at the central portion. The cushioning retention frame is made of a foamed material so as to help reducing the overall weight of the liquid crystal module package box. Further, the liquid crystal module package box is easy to manufacture, has a high throughput, and has a low packaging cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
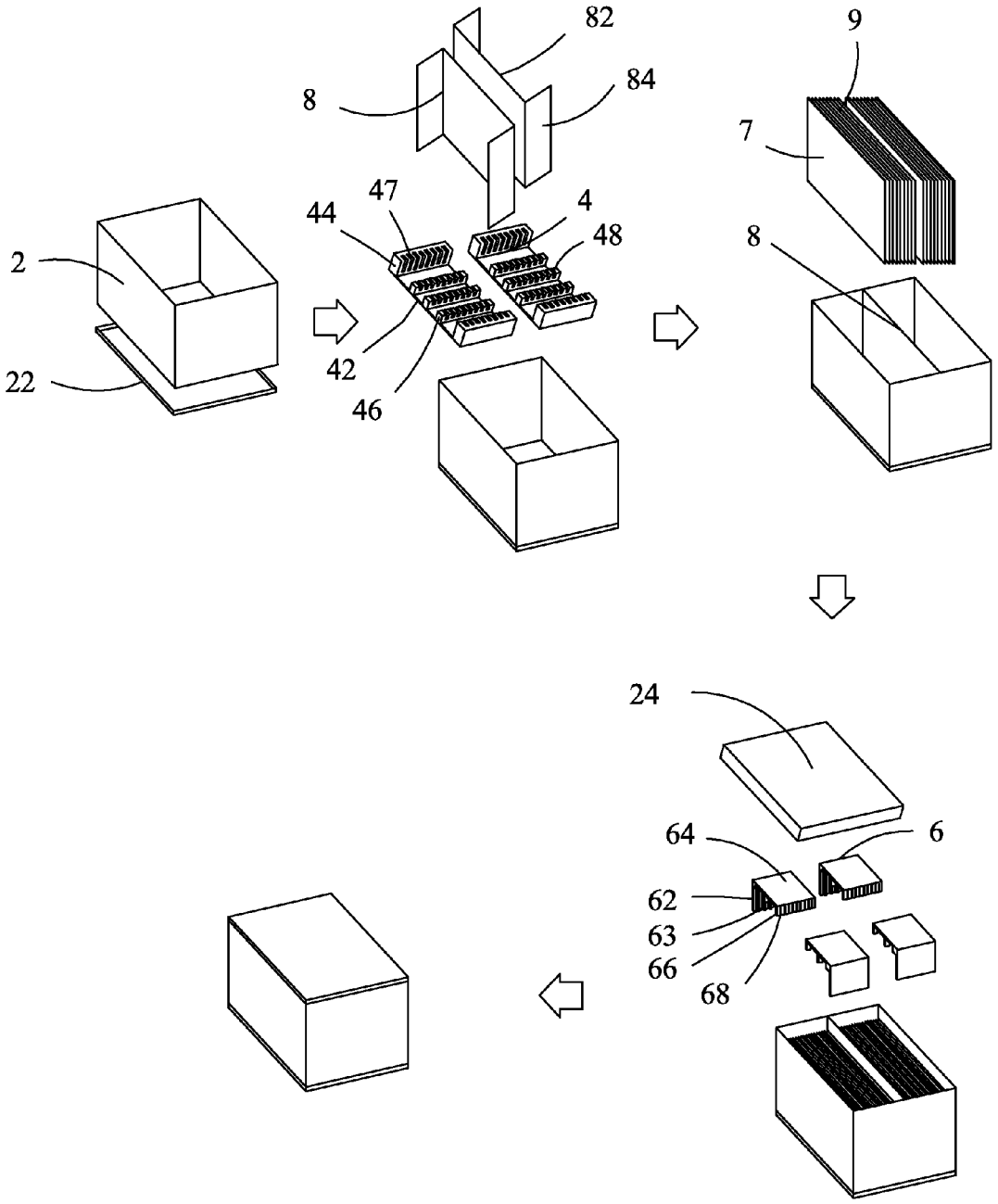
FIG. 1 is a schematic view illustrating an operational flow of packaging with a liquid crystal module package box according to a first preferred embodiment of the present invention.

Referring to FIG. 1, the present invention provides a liquid crystal module package box, which comprises a box body 2, top and bottom lids 24, 22 coupled to top and bottom of the box body 2, a cushioning retention frame (not labeled) received in the box body 2, cushioning pads 7 arranged at two sides of the cushioning retention frame, and a support unit (not labeled) arranged at a central portion of the box body 2. The cushioning retention frame comprises two lower cushioning brackets 4 and four upper cushioning brackets 6 corresponding to the two lower cushioning brackets 4. The support unit comprises two support boards 8. When liquid crystal modules 9 are positioned on the lower cushioning brackets 4, every two upper cushioning brackets 6 are set on the liquid crystal modules 9 to correspond to each individual lower cushioning brackets 4. The two support boards 8 are retained between the two lower cushioning brackets 4, namely being positioned in a central portion of the liquid crystal module package box to increase the compression strength of the liquid crystal module package box at the central portion.

The lower cushioning brackets 4 each comprise a first cushioning bottom board 42 and two first cushioning side boards 44 mounted on the first cushioning bottom board 42 and located at two ends of the first cushioning bottom board 42, and three first positioning cushioning boards 46 mounted on the first cushioning bottom board 42 between the two first cushioning side boards 44 in a spaced manner. The two first cushioning side boards 44 both form a plurality of spaced first mounting slots 47. The three first positioning cushioning boards 46 form a plurality of first positioning slots 48 corresponding to the first mounting slots 47. The upper cushioning brackets 6 each comprise a second cushioning bottom board 64, a second cushioning side board 62 mounted at one end of the second cushioning bottom board 64, and two second positioning cushioning boards 66 respectively mounted at a middle and an opposite end of the second cushioning bottom board 64. The second cushioning side board 62 forms a plurality of second mounting slots 63 corresponding to the first mounting slots 47. The second positioning cushioning boards 66 form a plurality of second positioning slots 68 corresponding to the second mounting slots 63. The second cushioning side board 62 and the second positioning cushioning boards 66 are mounted to the same surface of the second cushioning bottom board 64. When lower ends of a plurality of liquid crystal modules 9 are fit into the first mounting slots 47 and the first positioning slots 48 of the lower cushioning bracket 4, two upper cushioning brackets 6 are fit to upper ends of the plurality of liquid crystal modules 9. The upper ends of the plurality of liquid crystal modules 9 are received in the second mounting slots 63 and the second positioning slots 68.

The support boards 8 are each in the form of a U-shape and comprise a first main body 82 and two shoulder sections 84 respectively connected to two ends of the first main body 82. The two support boards 8 are arranged back to back to respectively surround the lower cushioning brackets 4 so as to separate the two lower cushioning brackets 4 and to effect supporting thereby achieve an effect of enhanced support, improving the compression strength of the central portion of the liquid crystal module package box. In a first preferred embodiment, the first main body 82 and two shoulder sections 84 are both made of corrugated boards.

The cushioning pads 7 and the cushioning retention frame are both made of foamed material. The foamed material has a reduced weight compared to lined-up corrugated boards so as to lower down the overall weight of the liquid crystal module package box to facilitate transportation. Further, the foamed material is superior to the corrugated boards in respect of performance of cushioning and shock absorbing. Preferably, the cushioning pads 7 and the cushioning retention frame are made of expandable polyethylene (EPE).

To pack liquid crystal modules, the bottom lid 22 is first mounted to the box body 2 to form a receiving space. The lower cushioning brackets 4 and the support unit are deposited in the receiving space. Afterwards, the liquid crystal modules 9 are positioned in the first mounting slots 47 and the first positioning slots 48 of the lower cushioning brackets and at the same time, the cushioning pads 7 are fit into gaps between the liquid crystal modules 9 at the two outer sides and the box body 2. The upper cushioning brackets 6 are then fit to the liquid crystal modules 9 and the top lid 24 is set to complete the packaging of the liquid crystal modules 9.

Figure 2:
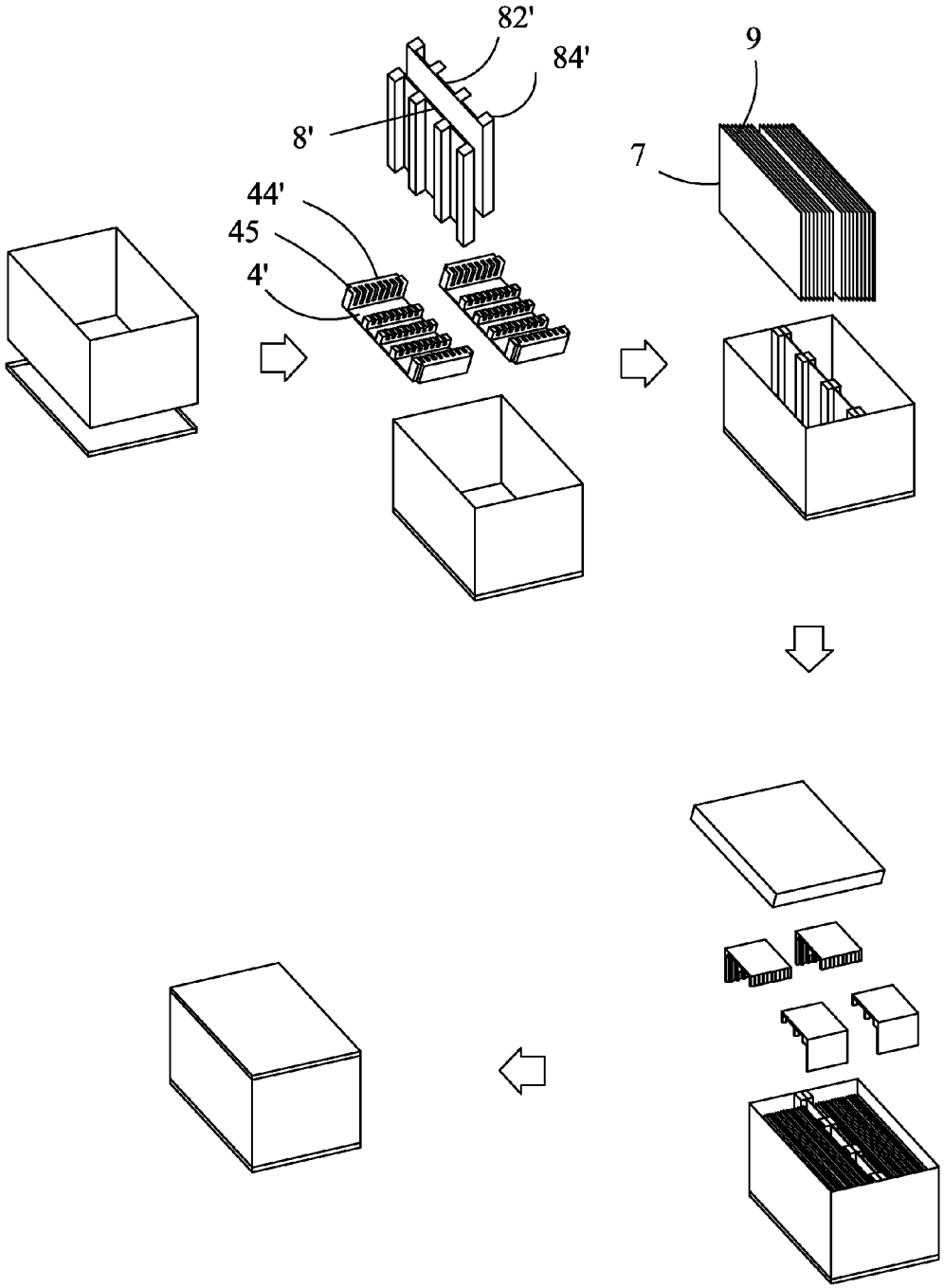
FIG. 2 is a schematic view illustrating an operational flow of packaging with a liquid crystal module package box according to a second preferred embodiment of the present invention.

Referring to FIG. 2, in a second, alternative preferred embodiment, the support boards 8' are each in a linear form and comprise a second main body 82' and a plurality of square tubes 84' mounted to one surface of the second main body 82'. The plurality of square tubes 84' is uniformly arranged on the second main body 82' and each of two ends of the second main body 82' is provided one of the square tubes 84'. The square tubes 84' function to retain the support boards 8' in position and improve compression strength of the support boards 8'. Preferably, the square tubes 84' are of a number of four. The second main body 82' is made of corrugated boards.

Each of the two first cushioning side boards 44' of each of the lower cushioning brackets 4' has two ends that form recesses 45 corresponding to the square tubes 84' of the two ends of each of the second main bodies 82'. To pack liquid crystal modules, the square tubes 84' are fit into and retained in the recesses 45 so as to retain the support boards 8' in position. Both ends of each of the two first cushioning side boards 44' are provided with recesses 45 to correspond to square tubes 84' so that in packing liquid crystal modules, it is not necessary to distinguish the locations where the lower cushioning brackets 4' are set. In other words, the locations of the two lower cushioning brackets 4' can be interchanged with each other so that packaging efficiency of liquid crystal modules can be improved. In the second embodiment, the square tubes 84' are each of a paper roll structure that is directly formed on the second main body 82' with corrugated boards, thereby improving production efficiency of the liquid crystal module package box wherein an integral formation process is adopted, production cost is reduced, and a subsequent operation of packaging liquid crystal modules is simplified.

Figure 3:
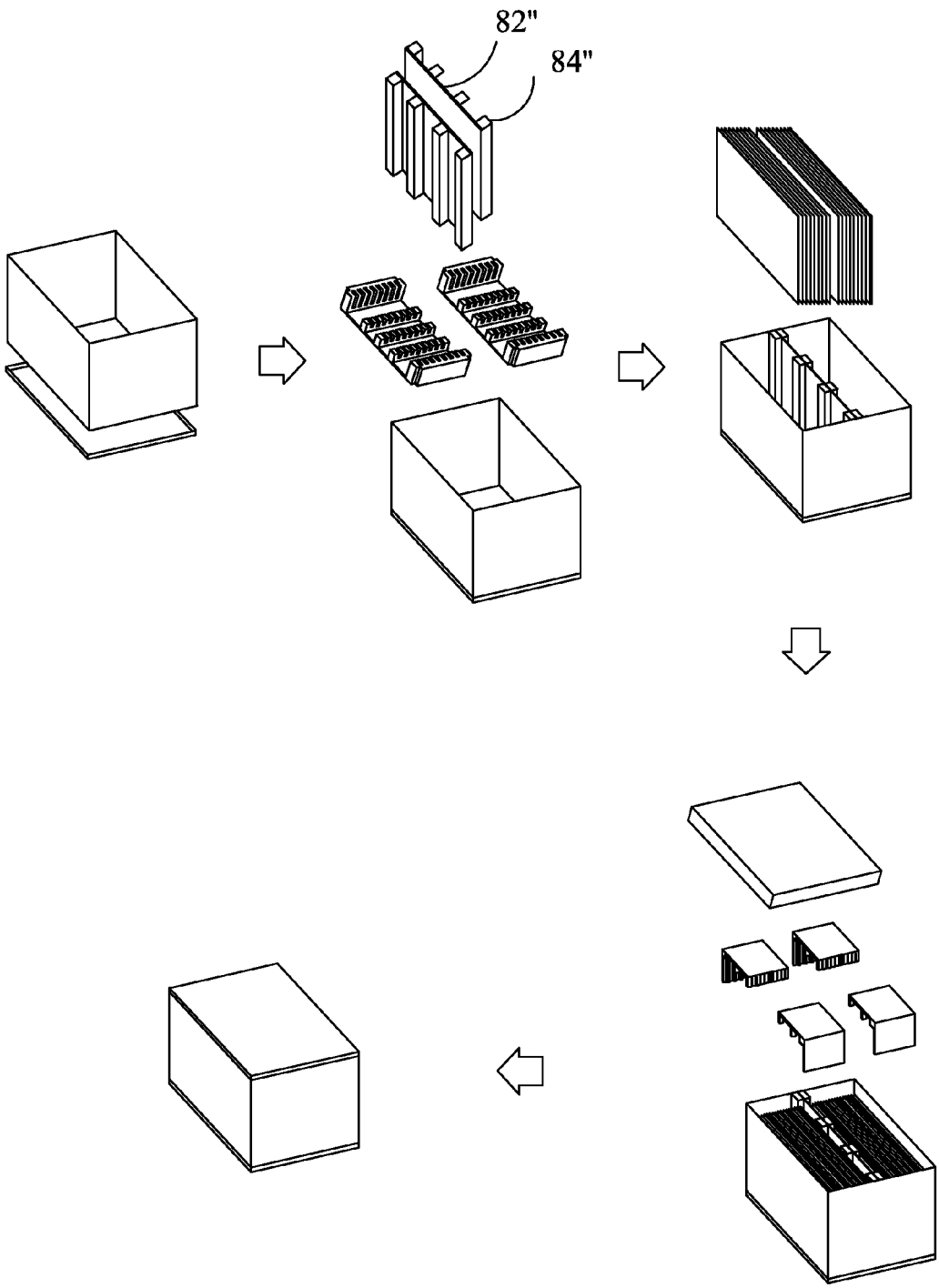
FIG. 3 is a schematic view illustrating an operational flow of packaging with a liquid crystal module package box according to a third preferred embodiment of the present invention.

Referring to FIG. 3, a third preferred embodiment is an improvement made on the basis of the second preferred embodiment, wherein the square tubes 84" are paper tubes made by adhesively bonding multiple layers of spool paper or brown paper and are adhesively mounted to the second main body 82", so that the second main body 82" and the square tubes 84" can be manufactured separately.

It is noted that in the liquid crystal module package box of the present invention, the cushioning retention frame is manufactured in an integral formation manner in order to improve manufacturing efficiency and throughput thereby facilitating reduction of cost of the liquid crystal module package box.

In summary, the present invention provides a liquid crystal module package box, which comprises a corrugated board made support unit set up in a central portion thereof to improve the compression strength of the liquid crystal module package box at the central portion. The cushioning retention frame is made of a foamed material so as to help reducing the overall weight of the liquid crystal module package box. Further, the liquid crystal module package box is easy to manufacture, has a high throughput, and has a low packaging cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A liquid crystal module package box, comprising a box body, top and bottom lids coupled to top and bottom of the box body, a cushioning retention frame received in the box body, cushioning pads arranged at two sides of the cushioning retention frame, and a support unit arranged at a central portion of the box body, the cushioning retention frame comprising two lower cushioning brackets and four upper cushioning brackets corresponding to the two lower cushioning brackets, the support unit comprising two support boards, whereby when liquid crystal modules are positioned on the lower cushioning brackets, every two of the upper cushioning brackets are set on the liquid crystal modules to correspond to each one of the lower cushioning brackets and the two support boards are retained between the two lower cushioning brackets to increase central compression strength of the liquid crystal module package box at the central portion;

wherein the support boards are each in a linear form and comprise a second main body and a plurality of square tubes mounted to one surface of the second main body, the plurality of square tubes being uniformly arranged on the second main body, each of two ends of the second main body being provided one of the square tubes, the second main body being made of corrugated boards; and wherein each of the two first cushioning side boards of each of the lower cushioning brackets has two ends that form recesses corresponding to the square tubes of the two ends of each of the second main bodies.

2. The liquid crystal module package box as claimed in claim 1, wherein the lower cushioning brackets each comprise a first cushioning bottom board and two first cushioning side boards mounted on the first cushioning bottom board and located at two ends of the first cushioning bottom board and three first positioning cushioning boards mounted on the first cushioning bottom board between the two first cushioning side boards in a spaced manner, the two first cushioning side boards both forming a plurality of spaced first mounting slots, the three first positioning cushioning boards forming a plurality of first positioning slots corresponding to the first mounting slots.

3. The liquid crystal module package box as claimed in claim 2, wherein the upper cushioning brackets each comprise a second cushioning bottom board, a second cushioning side board mounted at one end of the second cushioning bottom board, and two second positioning cushioning boards respectively mounted at a middle and an opposite end of the second cushioning bottom board, the second cushioning side board forming a plurality of second mounting slots corresponding to the first mounting slots, the second positioning cushioning boards forming a plurality of second positioning slots corresponding to the second mounting slots, the second cushioning side board and the second positioning cushioning boards being mounted to the same surface of the second cushioning bottom board.

4. The liquid crystal module package box as claimed in Claim 1, wherein the square tubes are each of a paper roll structure that is directly formed on the second main body with corrugated boards.

5. The liquid crystal module package box as claimed in Claim 1, wherein the square tubes are paper tubes made by adhesively bonding multiple layers of spool paper or brown paper and are adhesively mounted to the second main body.

6. The liquid crystal module package box as claimed in claim 1, wherein the cushioning pads and the cushioning retention frame are made of foamed materials and the cushioning pads and the cushioning retention frame are made of expandable polyethylene.

* * * * *